US006901859B2

(12) United States Patent
Yokoyama

(10) Patent No.: US 6,901,859 B2
(45) Date of Patent: Jun. 7, 2005

(54) WASHING DEVICE AND ITS METHOD FOR IMPRESSION CYLINDER JACKET IN SHEET-FED OFFSET TWO-SIDED PRINTING PRESS

(75) Inventor: Kazuhiro Yokoyama, Ichikawa (JP)

(73) Assignee: Tokyo Printing & Equipment Trading Co., Ltd., Tokyo (JP)

( * ) Notice: Subject to any disclaimer, the term of this patent is extended or adjusted under 35 U.S.C. 154(b) by 0 days.

(21) Appl. No.: 10/677,520

(22) Filed: Oct. 2, 2003

(65) Prior Publication Data

US 2004/0163561 A1 Aug. 26, 2004

(30) Foreign Application Priority Data

Feb. 24, 2003 (JP) ..... 2003-046177

(51) Int. Cl.[7] ..... B41L 41/00

(52) U.S. Cl. ..... 101/425; 101/424; 101/423; 101/216; 101/148

(58) Field of Search ..... 101/423, 424, 101/425, 142, 148, 216, 147

(56) References Cited

U.S. PATENT DOCUMENTS 4,311,095 A 1/1982 Jeschke
5,174,209 A 12/1992 Rodi et al.
5,277,111 A * 1/1994 Uribe et al. ..... 101/425

FOREIGN PATENT DOCUMENTS

| | | |
|---|---|---|
| DE | 44 44 453 A | 6/1996 |
| DE | 197 15 243 A | 10/1998 |
| DE | 197 25 505 A | 12/1998 |
| EP | 0 324 118 A | 7/1989 |
| EP | 0 453 853 A | 10/1991 |
| JP | 8012151 | 1/1996 |
| JP | 080121151 | 1/1996 |

* cited by examiner

*Primary Examiner*—Andrew H. Hirshfeld
*Assistant Examiner*—Marissa Ferguson
(74) *Attorney, Agent, or Firm*—Synnestvedt Lechner & Woodbridge, LLP; Richard C. Woodbridge, Esq.; Roy Rosser

(57) ABSTRACT

A washing device for an impression cylinder jacket in a sheet-fed offset two-sided printing press equipped with an impression cylinder installed with a jacket having a metal plate, a base layer formed to have concave-convex profile on the surface of the metal plate and a low surface energy resin layer formed on the base layer, includes a controller that executes a first control of causing a plate cylinder to contact with a blanket cylinder as well as the blanket cylinder to contact with the impression cylinder, and causes each cylinder to rotate under those contacts for a specified period of time while a cleaning unit is in contact with the blanket cylinder; and a second control of separating the plate cylinder from the blanket cylinder, and causing a water form roller and an ink form roller with the plate cylinder.

6 Claims, 10 Drawing Sheets

WASHING DEVICE AND ITS METHOD FOR IMPRESSION CYLINDER JACKET IN SHEET-FED OFFSET TWO-SIDED PRINTING PRESS

CROSS REFERENCE TO RELATED APPLICATIONS

This application is related to, and claims priority from Japanese Patent application No. 2003-046177 filed in the Japanese Patent Office on Feb. 24, 2003, the contents of which are hereby incorporated by reference.

BACKGROUND OF THE INVENTION

1. Field of the Invention

The present invention relates to a washing device and its method for an impression cylinder jacket in a sheet-fed offset two-sided (perfecting) printing press.

2. Description of the Related Art

The sheet-fed offset two-sided printing press with multicolor units is divided into two categories: one being an arrangement where the sheet is reversed during the course of its travel through plural printing units arranged only on one side of the sheet passage (either the top or the bottom) in order to be printed on both sides of the sheet, and the other being an arrangement where both sides of the sheet is alternately printed without reversing it by plural printing units arranged on both sides of the sheet passage.

In either case, while the ink on the already printed side of the sheet is not set yet and is still in contact with the impression cylinder, the other side of the sheet is printed as the sheet is pressed between a blanket cylinder and the impression cylinder. As a result, the ink on the already printed side of the sheet is transferred to the impression cylinder. Since the ink transferred to the impression cylinder is transferred back to the sheets to be fed thereafter, it causes staining in the printing process, thus making multicolor printing impossible under such a condition.

In order to solve this problem, technologies such as the one disclosed by Unexamined Publication No. JP-A-8-12151 are proposed. The technology disclosed by said publication intends to prevent the ink on paper immediately after printing from being transferred to the jacket installed on the impression cylinder by means of installing a jacket having smooth concave-convex profile with a surface roughness of Rmax of 20–40 $\mu$m formed by coating a metallic plate with porous ceramics by means of thermal spray, and then coating on top of it with a low surface energy resin of the silicone group resin, etc. (herein after called "separating compounds"). Thanks to this technology, it has become possible to conduct two-sided printing with multicolor on paper such as art paper or coated paper which does not absorb ink too well.

However, even when this jacket is used, it becomes necessary to wash the jacket once every 60,000 sheets of printing when the jacket is new, and every 10,000 sheets as the separating compounds in the convex areas of the ceramics coating layer (hereinafter called "ceramic convexes") on the jacket surface wears out.

If the jacket is to be manually washed, it requires the workers to work with unstable postures in very narrow space, so that there are problems in terms of safety and work efficiency. Consequently, various automatic washing devices for an impression cylinder jacket have been proposed and are used in order to solve the problems related to washing jacket by hand.

Let us now describe various types of conventional automatic washing devices for an impression cylinder jacket and their problems.

(1) First type of washing device with nonwoven fabric cloth impregnated with a washing liquid directly pressed against the impression cylinder FIG. 1 shows the first type of conventional washing device for an impression cylinder jacket. In the device shown in FIG. 1, while the machine is operated with a plate cylinder 121, a blanket cylinder 122, and an impression cylinder 123 rotating at a slow speed and all cylinders 121–123 are maintaining some distances from each other, nonwoven fabric cloth 131*b* impregnated with a washing liquid is directly pressed against impression cylinder 123, on which the jacket is mounted. This causes the ink on the jacket to be softened and the softened ink is then wiped out by the nonwoven fabric cloth. Also, blanket cylinder 122 is washed in a similar manner as nonwoven fabric cloth 131*a* is directly pressed against blanket cylinder 122. This type of washing device is divided into two types, one in which the washing liquid is sprayed from a nozzle on the dry nonwoven fabric cloth and the other in which the nonwoven fabric cloth is impregnated with a washing solvent beforehand.

However, the first type of washing device has a problem that not only the separating compounds in the convex ceramic areas but also the separating compounds in the concave areas on the jacket surface get worn out as the coarse nonwoven fabric cloth rubs the surface of the impression cylinder jacket strongly. The separating compounds is the key in preventing the ink from attaching to the jacket mounted on the impression cylinder. Therefore, if the separating compounds disappears as a result of the abrasion, the jacket can become easily stainable, thus causing staining on the printed matters, and causing a need for the jacket's replacement. In case of washing the jacket by hand to clean it, the life time of the jacket's replacement is typically required once in every 20 to 30 million printings, while the same cycle time becomes as short as once in 15 million printings, or approximately one half of the cycle time of the manual washing, when the first type of automatic washing device is used where the nonwoven fabric cloth is pressed directly against the impression cylinder.

When the impression cylinder rotates with the nonwoven fabric cloth pressed against the impression cylinder, the fibers of the nonwoven fabric cloth get tangled with the ceramic convexes on the surface of the jacket mounted on the impression cylinder and remain fibers on the jacket even after the washing process. These fibers can appear as white dots defects on the printed surface in the next printing job and caused the problem of printing defects.

Furthermore, the first type of washing device requires an expensive capital investment for the equipment since a washing device having a complicated mechanism with nonwoven fabric cloth needs to be installed into two very narrow spaces among blanket cylinder 122 and impression cylinder 123. Moreover, its running cost is quite high as the nonwoven fabric cloth needs to be frequently replaced.

(2) Second type of washing device having a brush roller pressed against and rotated with the impression cylinder in which the washing liquid is fed to the roller FIG. 2 shows the second type of conventional washing device for an impression cylinder jacket. In the device shown in FIG. 2, while the machine is operated with a plate cylinder 121, a blanket cylinder 122, and an impression cylinder 123 rotating at a slow speed and each of cylinders 121–123 is maintaining some distances from each other, a brush roller 141*b,* to which a washing liquid is fed, is directly pressed against impression cylinder 123 having the jacket. This makes it possible to wash down the ink on the jacket. Two different kinds of washing liquids can be fed through two nozzles 142*b* and 143*b.* Blanket cylinder 122 can also be washed similarly by having brush roller 141*a,* to which two different kinds of washing liquids are fed through two nozzles 142*a* and 143*a,* directly pressed against blanket cylinder 122. The used washing liquids can be either recycled or wasted.

However, the second type of washing device can not only remove the separating compounds on the ceramic convex areas on the jacket surface but also cause wears of the separating compounds in the concave areas, so that it shortens the life time of the jacket substantially similar to the abovementioned first type, since the brush is directly contacting the jacket surface while it is rotating.

Furthermore, similar to the first type of washing device, it requires an expensive capital investment for the equipment since a washing device having a complicated mechanism with a brush roller needs to be installed into two very narrow spaces among blanket cylinder 122 and impression cylinder 123. Moreover, it requires an expensive investment for the detergent recycling device if it is used, and if the washing liquid is not recycled, it requires a large scale waste liquid process.

(3) Third type of washing device having a cleaning unit that can be selectively contacted to the blanket cylinder that is opposing the impression cylinder, in which the blanket cylinder rotates for a definite period of time while it is contacting the impression cylinder with the cleaning unit pressed against the blanket cylinder FIG. 3 shows the third type of conventional washing device for an impression cylinder jacket. This third type of washing device is disclosed in said Unexamined Publication No. JP-A-8-12151, and is a washing device for washing a jacket formed a hybrid coating layer consisting of a thermal sprayed ceramic layer and a separating compounds layer.

In the device shown in FIG. 3, the machine (each of cylinders 121–123) is rotated at a slow speed while only plate cylinder 121 is separated from other cylinders with blanket cylinder 122 and impression cylinder 123 are contacted with each other, and nonwoven fabric cloth 131*a* impregnated with a washing liquid is pressed against blanket cylinder 122. Therefore, the ink on the jacket mounted on impression cylinder 123 softens as a result of a small amount of washing liquid transfered from blanket cylinder 122 while the blanket cylinder 122 and impression cylinder 123 make contact rotations, and the ink is transferred back to the blanket cylinder very easily because the jacket surface is coated with the separating compounds. Thus, the jacket mounted on impression cylinder 123 can be completely washed only by means of the washing mechanism having nonwoven fabric cloth 131*a* mounted on blanket cylinder 122.

Moreover, although blanket cylinder 122 and impression cylinder 123 are pressed to each other with a strong pressure, no abrasion occurs on the separating compounds on the surface of the jacket mounted on the impression cylinder because there is not any slip between the two cylinders at all. Further, needless to say, the nonwoven fabric cloth is not contacting the jacket directly so that there does not happen any problem about residual of the fibers from the nonwoven fabric cloth left on the jacket; it is indeed an excellent washing device.

This third type of washing device can be retrofitted on an existing press with a minimum capital investment as it requires almost no modification, requiring simply an addition of an electrical sequence, if blanket cylinder 122 can be stopped at a position when it contacts with impression cylinder 123, as it uses a method of causing blanket cylinder 122 to contact with impression cylinder 123 first and then contact with plate cylinder 121 as a means of causing plate cylinder 121 to contact with blanket cylinder 122, and blanket cylinder 122 with impression cylinder 123 (cylinder engagement mechanism system of the printing press).

However, the most popular cylinder engagement mechanism system at the moment is the method of causing blanket cylinder 122 to contact with plate cylinder 121 first, and then to contact with impression cylinder 123. If blanket cylinder 122 is washed while blanket cylinder 122 is in contact with impression cylinder 123 in such a cylinder engagement mechanism system, the jacket mounted on impression cylinder 123 gets washed of course, but the washing liquid transfers to plate cylinder 121 via blanket cylinder 122. If the washing liquid puts on plate cylinder 121, a plate installed on plate cylinder 121 can become sensitized, which causes staining, which is considered a defective printing. Therefore, this third type of washing device presents a problem that it cannot be adopted in current mainstream of printing presses.

On the other hand, if the third type of washing device is to be applied as is to the current mainstream of printing presses, it is necessary to modify the mechanism to allow blanket cylinder 122 to contact only with impression cylinder 123 in order to prevent the washing liquid from transferring to plate cylinder 121. This requires a substantial design change in the mechanism and the capital investment for the modification can be quite large.

SUMMARY OF THE INVENTION

It is an object of the present invention to provide a washing device and its method for an impression cylinder jacket in a sheet-fed offset two-sided printing press, which are improved for solving the abovementioned problems.

A more specific object of the present invention is to provide a washing device and its method for an impression cylinder jacket providing a high washing effect, without causing any abrasion or removal of the separating compounds by washing process, without leaving any fibers from the nonwoven fabric cloth, with an extremely inexpensive initial and running costs, and having a simple mechanism despite the fact that they are based on the cylinder engagement mechanism system.

According an aspect of the invention, there is provided a washing device for an impression cylinder jacket in a sheet-fed offset two-sided printing press equipped with an impression cylinder installed with a jacket having a flexible metal plate, a base layer formed to have concave-convex profile on the surface of said metal plate and a low surface energy resin layer formed on said base layer, comprising: a cleaning unit capable of being in contact with or separated from a blanket cylinder that opposes said impression cylinder; a water dampening unit equipped with a water form roller capable of being in contact with or separated from a plate cylinder that opposes said blanket cylinder and supplying water to said plate cylinder; an inking unit equipped with an ink form roller capable of being in contact with or separated from said plate cylinder and supplying ink to said plate cylinder; and a controller that executes a first control of causing said plate cylinder to contact with said blanket cylinder and said blanket cylinder to contact with said impression cylinder, and causes each cylinder to rotate under those contacts for a specified period of time while said cleaning unit is in contact with said blanket cylinder; and a second control of separating said plate cylinder from said blanket cylinder, and causing said water form roller and said ink form roller with said plate cylinder.

As abovementioned, the third type of washing device is an excellent washing device for an impression cylinder jacket, but its biggest problem is that it causes sensitization of the surface of the plate cylinder (plate surface) by the washing liquid during the process of washing the blanket cylinder and the impression cylinder on a printing press using a method of causing the blanket cylinder to contact with the plate cylinder first and then with the impression cylinder as the cylinder engagement mechanism system. The present invention provides a solution to such a problem.

In the present invention, the plate, blanket and impression cylinders are rotated at a slow speed for a definite period of time with the blanket cylinder being brought into an engagement causing the blanket cylinder to contact to the plate cylinder and the blanket cylinder to contact also to the impression cylinder with rotations, while the cleaning unit is pressed against the blanket cylinder, so that the blanket cylinder and the impression cylinder can be washed simultaneously. Moreover, in the present invention, after washing the blanket cylinder and the impression cylinder and also separating the blanket cylinder from the plate cylinder, an ink form roller is pressed against the plate cylinder while feeding water to the plate cylinder by pressing a water form roller against the plate cylinder.

When water is supplied to the plate cylinder after washing the blanket cylinder and the impression cylinder and also separating the blanket cylinder from the plate cylinder, the non-image areas of the plate surface comes to have a strong hydrophilicity so that the residual washing liquid, which has been put on the plate from the cleaning unit via the blanket cylinder, floats on the water membrane and furthermore can be easily adsorbed into the ink form roller by contacting the ink form roller with the plate surface. This effectively prevents the sensitization of the plate surface. Since this prevents the residual washing liquid from reaching the water form roller as the residual washing liquid is moved away by the ink form roller, there will not be caused the bad influence to the downstream printing job.

Also, most of the sheet-fed offset two-sided printing presses with multicolor are equipped with a washing mechanism for a blanket as a standard equipment having a cleaning unit capable of arbitrarily contacting with and separating from the blanket cylinder. Therefore, the adoption of the washing method according to the present invention makes it possible to wash the blanket cylinder, the impression cylinder and the plate cylinder all at once by merely adding a small modification to the electrical sequence in the conventional printing press and using only a washing mechanism for the blanket cylinder without requiring a washing mechanism for the impression cylinder. Moreover, the offset printing press is always equipped with a water dampening unit and an inking unit, and they can be used for the abovementioned purpose without causing any need for adding them anew.

Thus, it is possible to provide a washing device for an impression cylinder jacket featuring a simple mechanism, a high washing efficiency, and extremely inexpensive initial and running costs, that does not leave any nonwoven fabric fibers and is applicable regardless of the type of cylinder engagement mechanism system.

Furthermore, adopting the washing method according to this invention makes it possible to remove paper dust easily in addition to the ink on the jacket mounted on the impression cylinder by means of a blanket washing mechanism equipped with a cleaning unit to which the washing solvent and water are supplied during the washing cycle. The washing liquid normally used in the washing mechanism of the blanket cylinder is a petroleum-based solvent, so that, while it can dissolve the ink on the blanket cylinder and the jacket on the impression cylinder, it is not sufficient for removing paper dust (coating materials such as calcium carbonate, etc., coated on paper) put on the jacket by itself.

According another aspect of the invention, there is provided a washing method for an impression cylinder jacket in a sheet-fed offset two-sided printing press equipped with an impression cylinder installed with a jacket having a flexible metal plate, a base layer formed to have concave-convex profile on the surface of said metal plate and a low surface energy resin layer formed on said base layer, comprising the steps of: 1) rotating said impression cylinder, a blanket cylinder opposing said impression cylinder, and a plate cylinder opposing said blanket cylinder; 2) causing a cleaning unit capable of being in contact with or separated from said blanket cylinder to contact with said blanket cylinder; 3) causing said plate cylinder to contact with said blanket cylinder and said blanket cylinder to contact with said impression cylinder while keeping said cleaning unit in contact with said blanket cylinder; 4) separating said plate cylinder from said blanket cylinder after causing each cylinder to rotate in such contacts for a specified period of time; and 5) causing a water form roller capable of being in contact with or separated from said plate cylinder in a water dampening unit capable of supplying water to said plate cylinder, and an ink form roller capable of being in contact with or separated from said plate cylinder in an inking unit to contact with said plate cylinder.

The objects, features, and characteristics of this invention other than those set forth above will become apparent from the description given herein below with reference to preferred embodiments illustrated in the accompanying drawings.

DETAILED DESCRIPTIONS OF THE PREFERRED EMBODIMENTS

The embodiments of this invention will be described below with reference to the accompanying drawings.

Figure 4:
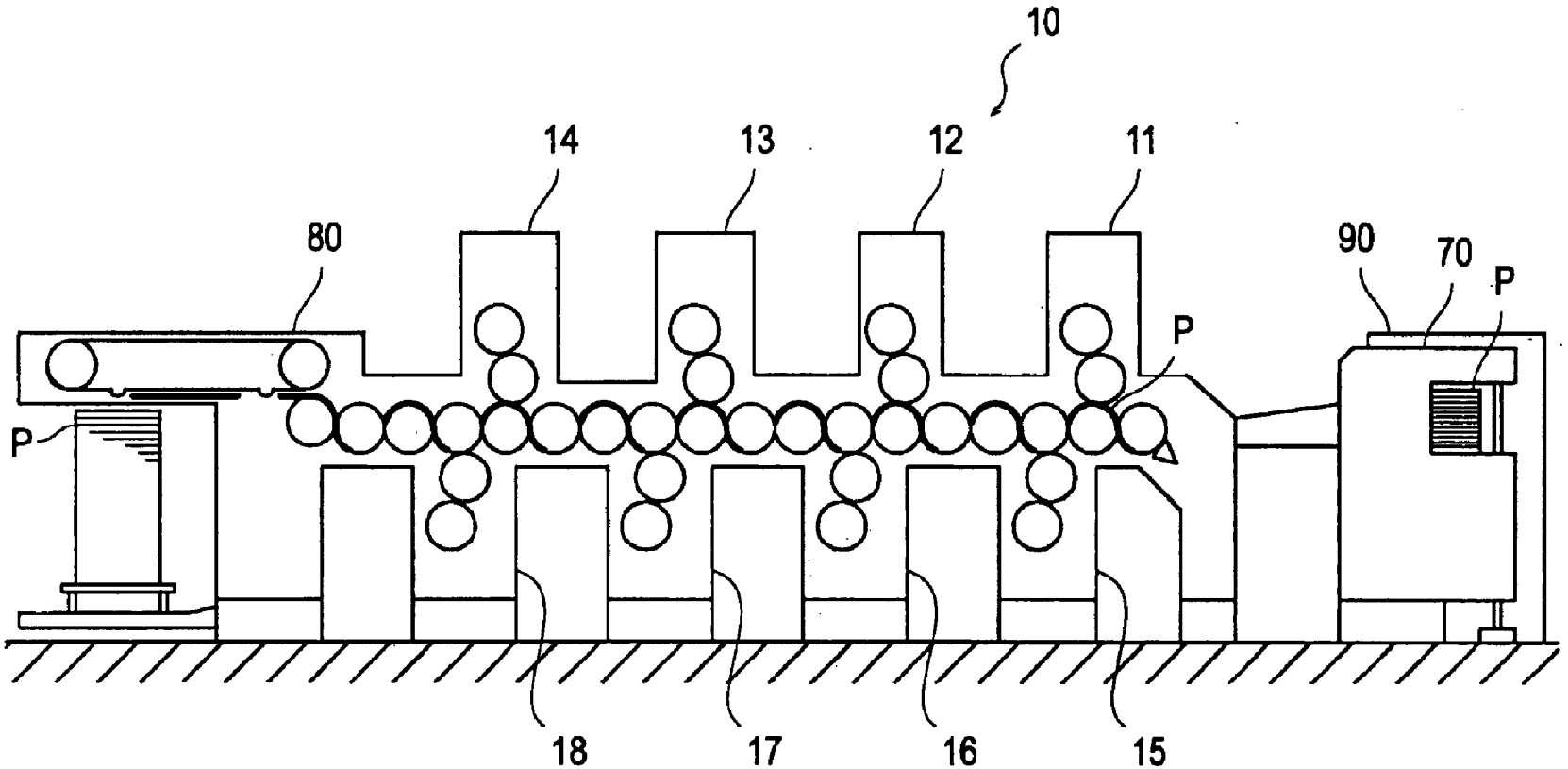
FIG. 4 shows the system layout of a sheet-fed offset two-sided printing press to which a washing device for an impression cylinder jacket according to an embodiment of the invention is applied.

FIG. 4 shows the system layout of a sheet-fed offset two-sided printing press to which a washing device for an impression cylinder jacket according to an embodiment of the invention is applied.

The sheet-fed offset two-sided printing press shown in FIG. 4 has a printing section 10 for making a specified printing on a sheet of paper P (hereinafter simply called "paper") being transferred, a feeding section 70 for separating stacked paper P one by one and feeding it out to the printing section 10, and a delivery section 80 for stacking printed paper transferred from printing section 10.

Printing section 10 consists of plural printing units 11 through 18. Printing units 11 through 14 are arranged on the upper side of the transfer passage for paper P and are suitable for printing the top face of paper P, while printing units 15 through 18 are arranged on the lower side of the transfer passage for paper P and are suitable for printing the bottom face of paper P. Printing units 11 and 15 use black (B) ink, printing units 12 and 16 use cyan (C) ink, printing units 13 and 17 use magenta (M) ink, and printing units 14 and 18 use yellow (Y) ink. As can be seen from the above, the printing press shown in FIG. 4 describes a system layout of a sheet-fed offset two-sided 4/4 colors printing press on which a method of alternate printing both sides of paper without reversing paper.

Figure 5:
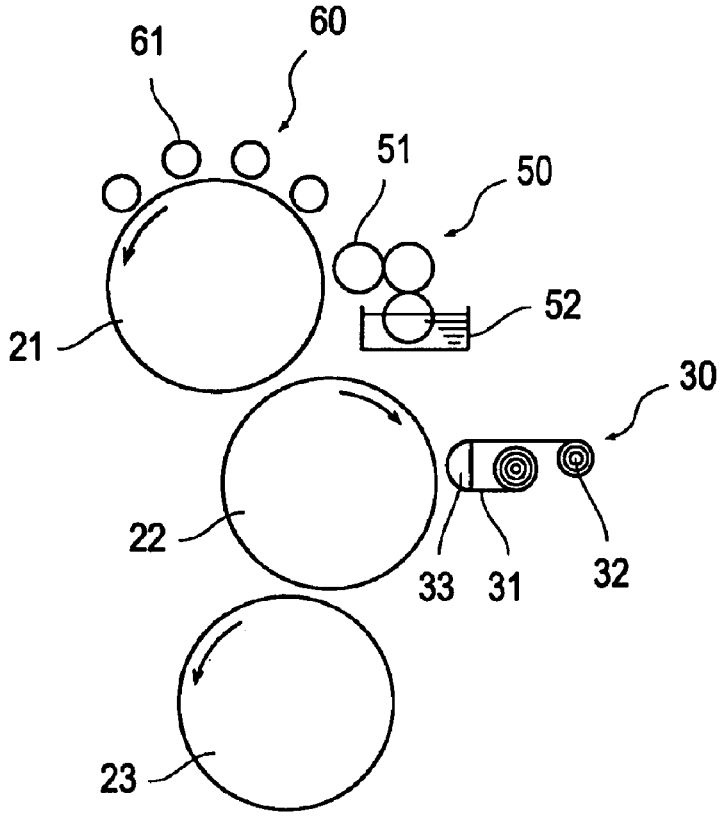
FIG. 5 shows an example system arrangement of a printing unit.

FIG. 5 shows an example system arrangement of a printing unit 11. The operation of printing unit 11 will be described below and descriptions for other printing units 12 through 18 are omitted because they are identical with printing unit 11.

As shown in FIG. 5, printing unit 11 has a plate cylinder 21 on which a plate (not shown) is attached to, a blanket cylinder 22 for transferring ink of printing image on the plate attached to plate cylinder 21 to the paper, and an impression cylinder 23 that grips the paper with grippers (not shown) and presses the paper against blanket cylinder 22. A rubber layer is arranged on the surface of blanket cylinder 22 to control a proper printing pressure. As shown in the drawing, blanket cylinder 22 is arranged as opposed to impression cylinder 23, while plate cylinder 21 is arranged as opposed to blanket cylinder 22. The paper is transferred one by one from the right hand side in the drawing, gripped by the grippers of impression cylinder 23, and made to contact with blanket cylinder 22 under a pressure.

Figure 6:
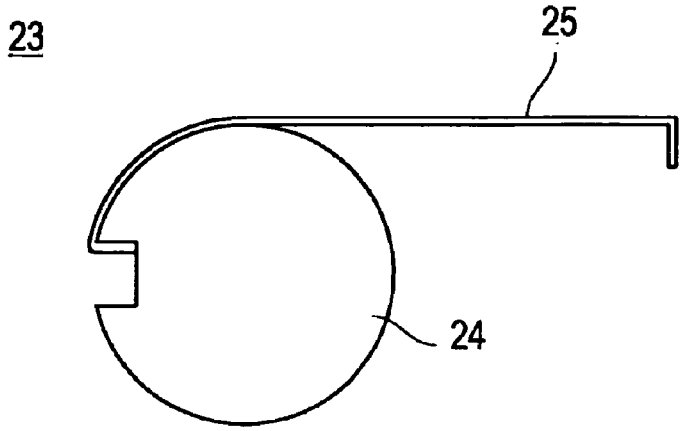
FIG. 6 shows an example structure of an impression cylinder.

FIG. 6 shows an example structure of an impression cylinder 23. As shown in FIG. 6, impression cylinder 23 consists of a impression cylinder member 24 and a jacket 25 set around impression cylinder member 24.

Figure 7:
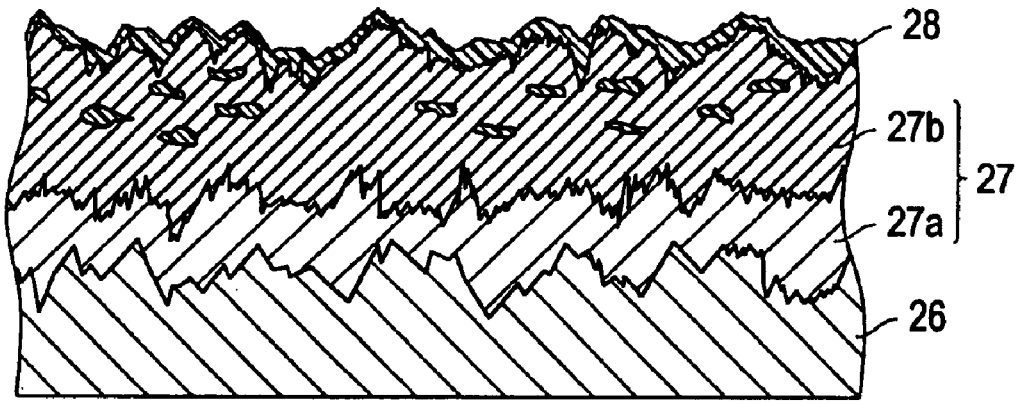
FIG. 7 is a partially enlarged cross-sectional view schematically showing an example structure of a jacket.
Figure 8:
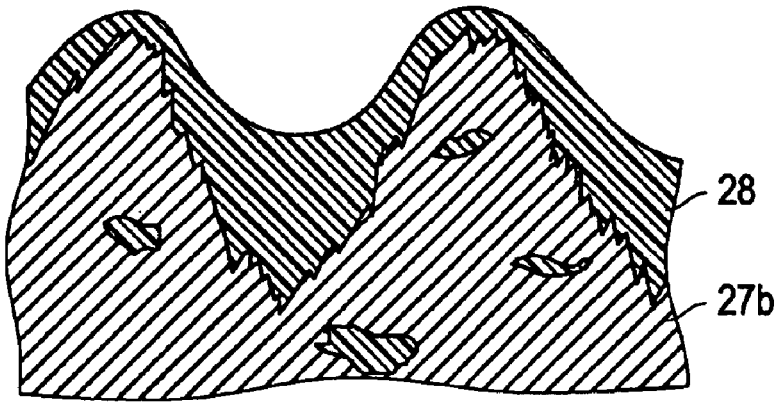
FIG. 8 is a further enlarged cross-sectional view showing a part of FIG. 7.

FIG. 7 is a partially enlarged cross-sectional view schematically showing an example structure of jacket 25, and FIG. 8 is a further enlarged cross-sectional view showing a part of FIG. 7. As shown in FIG. 7, jacket 25 has a flexible metal plate 26, a base layer 27 having a surface of concave-convex profile formed on metal plate 26, and a low surface energy resin layer 28 formed on base layer 27. Base layer 27 consists of a hard metal thermal sprayed layer 27*a* formed by thermally spraying a metal, and a porous ceramic thermal sprayed layer 27*b* formed by thermally spraying a ceramic on metal thermal sprayed layer 27*a*. However, base layer 27 is not limited to said structure, but can be consisted of only metal thermal sprayed layer 27*a*.

In manufacturing jacket 25, metal thermal sprayed layer 27*a* is formed by thermally spraying, e.g., Ni—Cr, on the surface of a metal plate 26, e.g., of stainless steel (SUS) plate, prepared by degreasing and shot-blasting it to produce a coarse surface, and then a ceramic thermal sprayed layer 27*b* is formed on top of it. A ceramic material such as gray alumina (G-$Al_2O_3$) is normally used for forming ceramic thermal sprayed layer 27*b*. The surface of a ceramic thermal sprayed layer 27*b* thus formed is a coarse surface having a composition of short cyclic concaves and convexes with very sharp protrusions (pitch like concaves and convexes) and longer cyclic concaves and convexes (wavy concaves and convexes) as shown in the drawing, preferably with a surface roughness of approximately Rmax 30–50 $\mu$m. Ceramic thermal sprayed layer 27*b* is a porous layer preferably with a porosity of 5–20% having minute pores of diameters ranging from 0.1 $\mu$m to several ten $\mu$m. A low surface energy resin (separating compounds) of silicone-based resin and the like is coated by impregnation and dried to solidify on top of said ceramic thermal sprayed layer 27*b*. This forms a low surface energy resin layer 28 on the surface and in the pores of ceramic thermal sprayed layer 27*b* as shown in FIG. 7 and FIG. 8.

Although low surface energy resin layer 28 covers essentially the whole surface of ceramic thermal sprayed layer 27*b*, the layer 28 is covered thicker in the wavy concave areas and thinner in the wavy convex areas. Consequently, the surface is smoother than when only ceramic thermal sprayed layer 27*b* is formed. The concave-convex profile formed in ceramic thermal sprayed layer 27*b* does not completely flattened out, rather said wavy concaves and convexes are generally maintained so that a coarse surface with a smooth concave-convex profile will be formed. It is preferably to have a typical final surface roughness of approximately Rmax 20–40 $\mu$m. It is preferable that the convex areas (convex parts in said waviness) in the final smooth concave-convex profile are preferable to be scattered evenly to appear once in every 0.2 mm×0.2 mm to 1 mm×1 mm squares. The convex area mentioned here is defined as a convex area having a peak higher than 70% of the highest protrusion measured by scanning two dimensionally a square area of 20 mm×20 mm.

When impression cylinder 23 mounted with a jacket 25 manufactured in such a way makes a contact with the paper as an object to be printed, the contact does not occur on the whole surface of jacket 25; rather it occurs only on the abovementioned smooth convexes, and there is hardly any transfer of the ink from the paper occurred thanks to the presence of low surface energy resin layer 28 on the surface of the jacket.

Washing device for the impression cylinder jacket applied on the printing press shown in FIG. 4 will be described with reference to the system arrangement drawing of the printing unit shown in FIG. 5. Washing device for the impression cylinder jacket according to this embodiment has a washing mechanism 30 including nonwoven fabric cloth 31 as a cleaning unit capable of arbitrarily contacting with and separating from blanket cylinder 22, a water dampening unit 50 capably of supplying water to plate cylinder 21, and an inking unit 60 capable of supply the ink to plate cylinder 21.

Washing mechanism 30 has a rewinding shaft 32 for rewinding nonwoven fabric cloth 31. Nonwoven fabric cloth 31 is rewinded by rewinding shaft 32 once in several seconds so that a new surface of the cloth always stands by against blanket cylinder 22. Used nonwoven fabric cloth 31 will be replaced with a new one. Nonwoven fabric cloth 31 used in this embodiment is nonwoven fabric cloth, which is impregnated with the washing liquid (washing solvent and water) supplied during the washing process. Washing solvent or water is sprayed toward nonwoven fabric cloth 31 alternately from a nozzle mounted in head unit 33. However, it can be also available nonwoven fabric cloth impregnated with the washing solvent in prior to the washing process. The washing mechanism according to the invention is not limited to the one that uses nonwoven fabric cloth, but rather it can be also available a washing mechanism with a brush to which the washing liquid (washing solvent and water) is supplied at the time of the washing process.

Water dampening unit 50 has a water form roller 51 capable of arbitrarily contacting with or separating from plate cylinder 21 and a water pan 52 for keeping the water to be supplied to water form roller 51. Water dampening unit 50 shown in FIG. 5 is just an example and the water dampening unit of this invention is not limited to it and various other water dampening system can be used.

Inking unit 60 has plural ink form rollers 61 capable of arbitrarily contacting with or separating from plate cylinder 21. Inking unit 60 shown in FIG. 5 is another example.

These mechanism, washing mechanism unit 30, water dampening unit 50 and inking unit 60, as abovementioned, are provided on a typical sheet-fed offset two-sided printing press with multicolor.

Washing device for the impression cylinder jacket according to this embodiment has a control unit 90 (see FIG. 4) capable of executing an electrical sequence for causing cylinders 21 through 23 to rotate under contact for a definite period of time while maintaining plate cylinder 21 and blanket cylinder 22 as well as blanket cylinder 22 and impression cylinder 23 in contact with each other, and also nonwoven fabric cloth 31 of washing mechanism 30 and blanket cylinder 22 in contact with each other, and an electrical sequence for pressing a water form roller against the plate cylinder while supplying water to the plate cylinder and pressing ink form rollers against the plate cylinder as well so as to cause them to rotate under contact.

Figure 9:
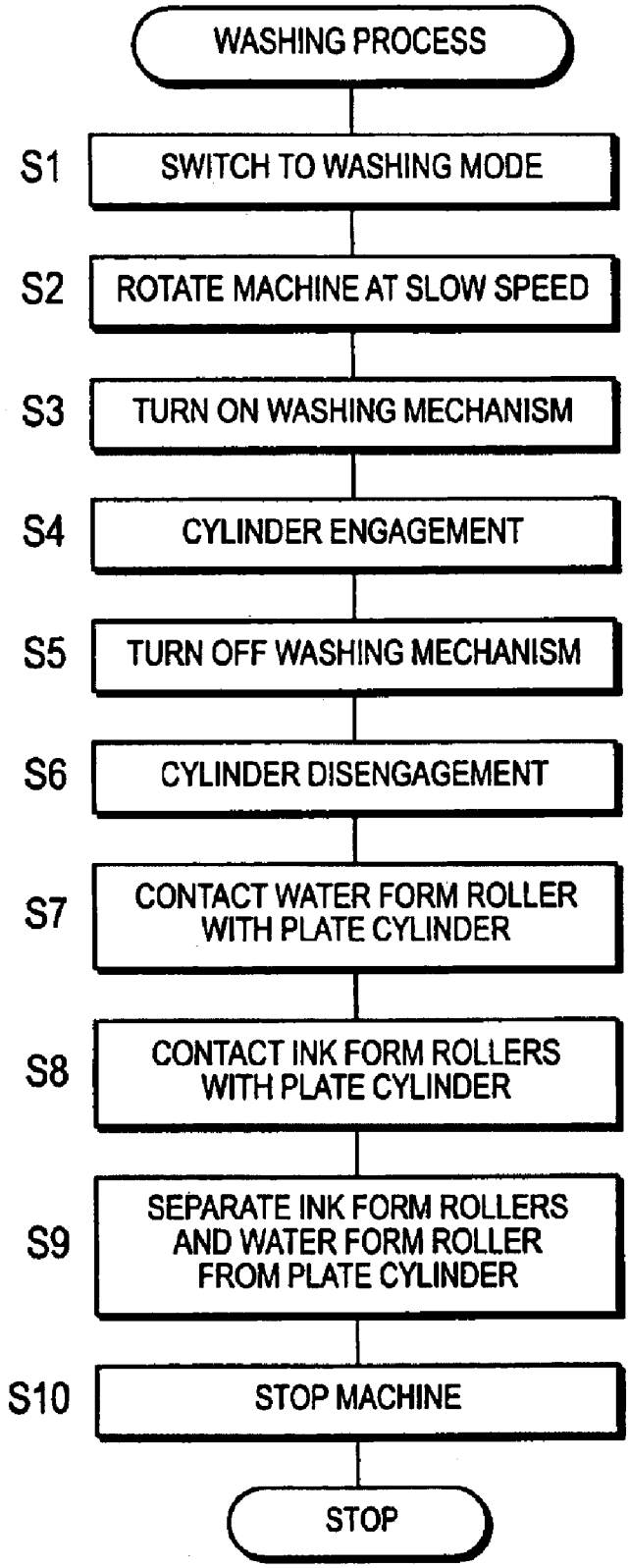
FIG. 9 is a flowchart for describing the washing process.

Next, the operation of the washing device for the impression cylinder jacket in the embodiment will be described with reference to FIG. 9 through FIG. 13. FIG. 9 shows a flowchart for describing the washing process and FIG. 10 is a time chart for describing the washing process.

Washing process for the impression cylinder jacket is executed after the printing job is completed and the printing press is temporally stopped (each of cylinders 21 through 23 is separated from each other). At this point in time, the surfaces of plate cylinder 21 (plate), blanket cylinder 22, and impression cylinder 23 (jacket 25) are covered with the ink related to the image patterns of the previous printing job.

Figure 10:
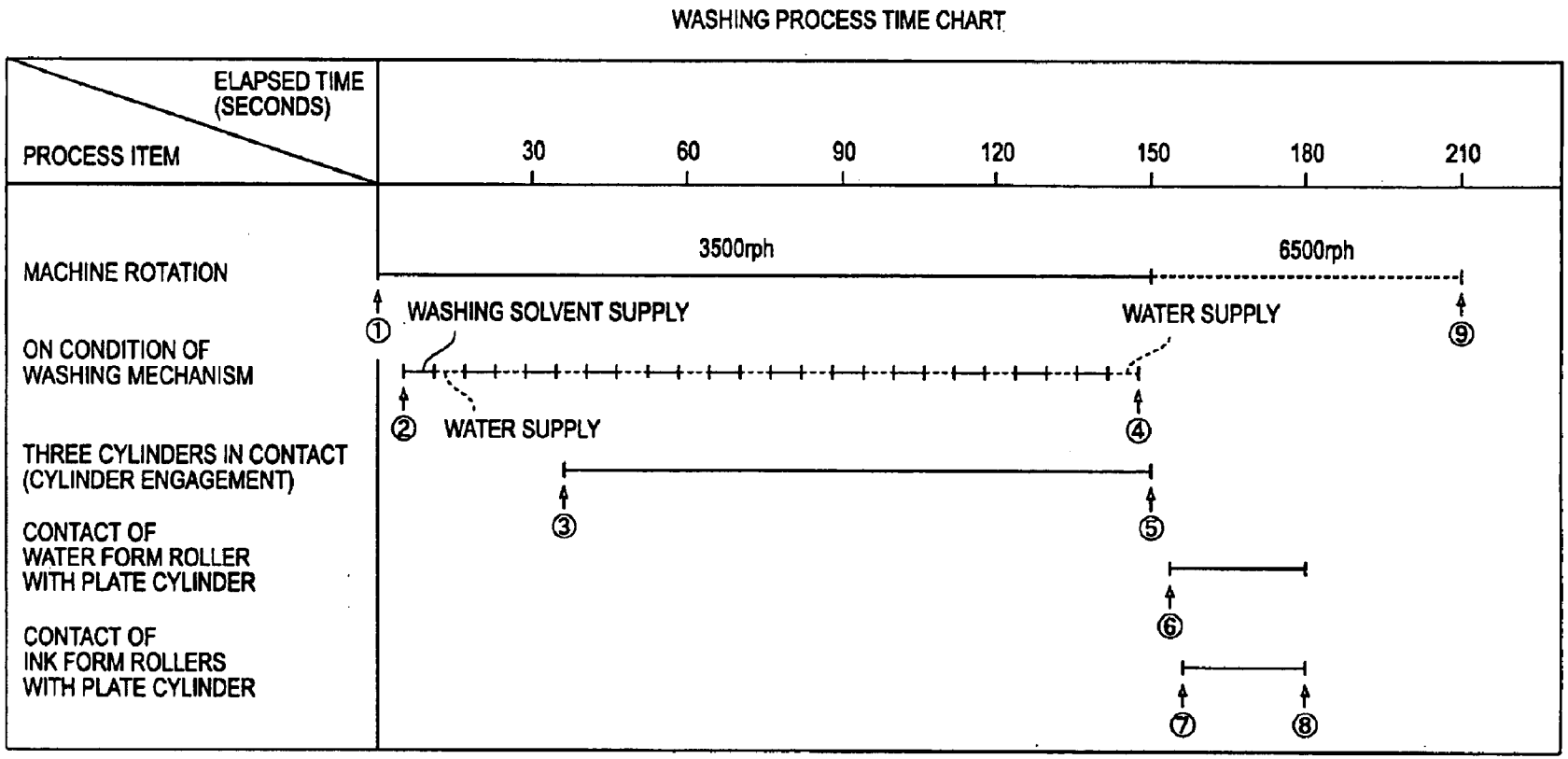
FIG. 10 is a time chart for describing the washing process.

After switching to a washing mode (S1) by means of a switch (not shown), the machine (plate cylinder 21, blanket cylinder 22, and impression cylinder 23) is rotated at a specified slow speed (S2; ① of FIG. 10). Although the rotating speed is set to a definite fixed speed, e.g., 3500 rph, it can be arbitrarily adjusted.

Figure 11:
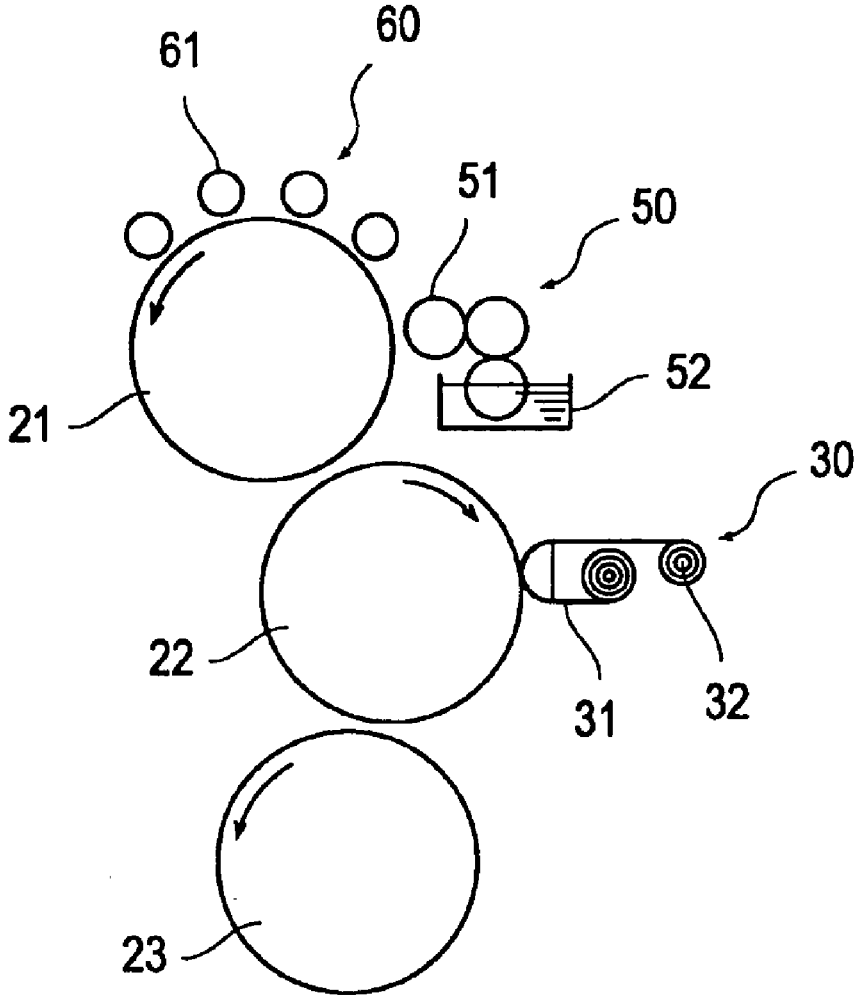
FIG. 11 is a diagram showing the status of each cylinder, a washing mechanism, a water form roller and ink form rollers during washing process of a blanket cylinder.

Next, washing mechanism 30 is turned on (S3; ② of FIG. 10). In other words, nonwoven fabric cloth 31 of washing mechanism 30 is pressed against the surface of blanket cylinder 22 as shown in FIG. 11. Also, washing solvent and water are supplied alternately to nonwoven fabric cloth 31 to impregnate it with them as shown in FIG. 10. The switching interval time between the washing solvent (period shown by a solid line) and water (period shown by a dotted line) is, although exaggerated in FIG. 10 for ease of view, preferably in terms several seconds and is arbitrarily adjustable. At this time, each of cylinders 21 through 23 is separated from each other and the washing is concentrated on only blanket cylinder 22, which is most heavily attached with the ink related to the image patterns of the previous printing. The washing for blanket cylinder 22 only is executed for 30 seconds, for example, the execution time is arbitrarily adjustable. This process can remove most of the ink left on blanket cylinder 22.

Figure 12:
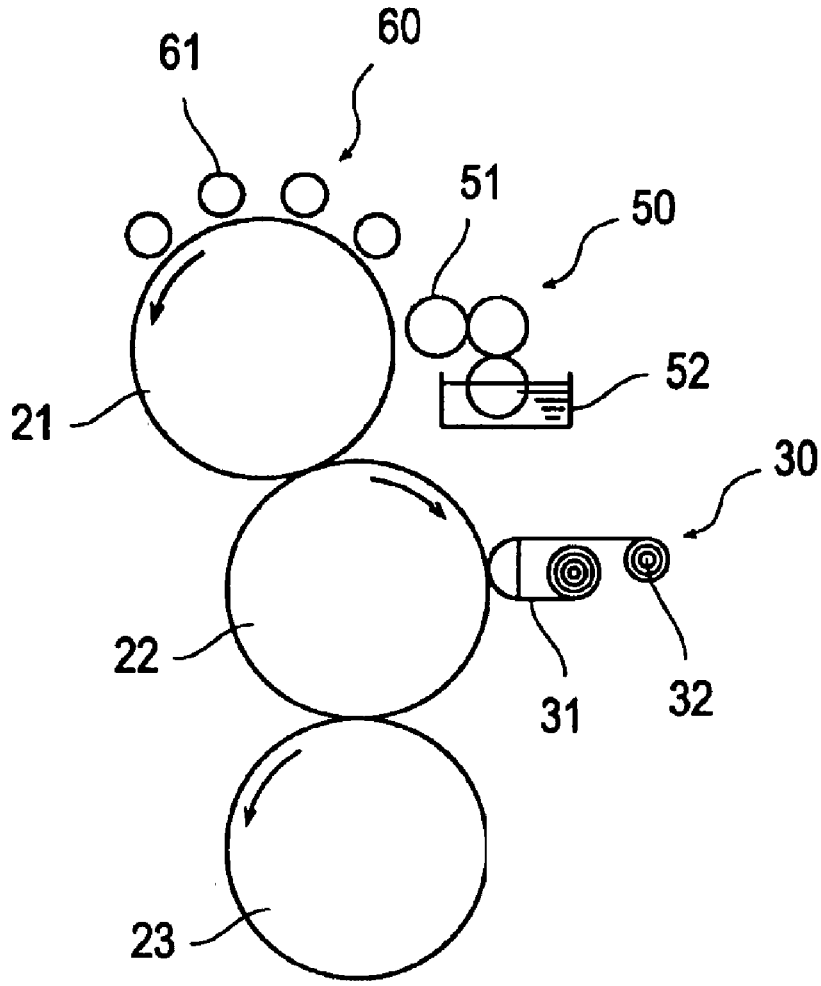
FIG. 12 is a diagram showing the status of each cylinder, a washing mechanism, a water form roller and ink form rollers during a simultaneous washing process of a blanket cylinder, an impression cylinder and a plate cylinder.

Next, the cylinder engagement is performed (S4; ③ of FIG. 10). In other words, blanket cylinder 22 is pressed against plate cylinder 21 and impression cylinder 23 while the machine is running at a slow speed rotation as shown in FIG. 12. At this time, washing mechanism 30 follows the movement of blanket cylinder 22. Thus, the contact between washing mechanism 30 and blanket cylinder 22 is maintained, washing solvent and water are alternately supplied to nonwoven fabric cloth 31, and the washing by washing mechanism 30 continues on.

A printing pressure applied between blanket cylinder 22 and impression cylinder 23 is indicated by the volume (distance) of relative movement of the two cylinders from the point when a sheet of paper having a certain thickness is placed between the two cylinders and the paper and the two cylinders are just contacting with each other with no pressure between them. The printing pressure is set up for each printing press as a fixed condition (value) and is normally set at 0.15 mm. Therefore, the distance between blanket cylinder 22 and impression cylinder 23 is adjusted depending on the thickness of the paper used to control a printing pressure of 0.15 mm. The thickness of the paper used can be set up as a printing pressure preset value. For example, if the printing pressure preset value is to be set up to be 0.05 mm, the distance between blanket cylinder 22 and impression cylinder 23 is adjusted so that the printing pressure will be 0.05 mm using a sheet of paper with a thickness of 0.05 mm. In this case, blanket cylinder 22 and impression cylinder 23 are moved closer 0.1 mm (=0.15 mm−0.05 mm) relative to each other from the condition that the two cylinders are contacting with zero pressure with having the paper between them. In this embodiment, the pressing condition between blanket cylinder 22 and impression cylinder 23 can be set, for example, arbitrarily between 0.05 and 0.10 mm.

This condition is held for a prescribed time (e.g., several minutes, which is adjustable arbitrarily). Consequently, the ink remaining on jacket 25 mounted on impression cylinder 23 will be softened by the washing liquid from blanket cylinder 22 and easily transferred back to blanket cylinder 22 and washed clean thanks to the contact rotation of blanket 22 and impression cylinder 23 leaving jacket clean. What is important here is that, although it takes a lot of time for the ink put on the impression cylinder to be completely transferred to the blanket cylinder in case of the impression cylinder used in the conventional printing press (impression cylinder having smooth roughness prepared by simply chromium plating the steel surface), the staining of the impression cylinder jacket can be easily transferred to the blanket cylinder and be washed clean quickly thanks to the repulsive nature of the low surface energy resin against ink and oil as the impression cylinder jacket coated with the low surface energy resin in case of the present invention. Moreover, since no slip occurs between the blanket cylinder and the impression cylinder, no abrasion occurs in the separating compounds on the surface of the jacket mounted on the impression cylinder. Since the nonwoven fabric cloth does not contact directly with jacket 25, fibers from the nonwoven fabric cloth would not be left on jacket 25, so that white dots defects in the next printing can be prevented. Moreover, the blanket cylinder and the impression cylinder can be simultaneously cleaned using only the blanket cylinder washing device by modifying the electrical sequence slightly on the conventional printing press without requiring a separate washing mechanism for the impression cylinder.

Furthermore, it is possible to remove paper dust easily as well as the ink on the jacket mounted on the impression cylinder by adopting a blanket washing mechanism equipped with a cleaning unit to which the washing solvent and water are supplied during the washing process.

This embodiment is constituted in such a way that all washing jobs for blanket cylinder 22 and impression cylinder 23 be completed simultaneously with the completion of the washing process for nonwoven fabric cloth 31 supplying water. This makes it possible to minimize the washing solvent remaining on the plate surface.

After washing blanket cylinder 22 and impression cylinder 23, washing mechanism 30 is turned off (S5; ④ of FIG. 10), and the cylinders are disengaged (S6; ⑤ of FIG. 10). Moving blanket cylinder 22 away to separate each of cylinders 21 though 23 from each other is called "cylinder disengagement." After the cylinder disengagement, the rotational speed of the machine (plate cylinder 21, blanket cylinder 22, and impression cylinder 23) is increased to a specified speed, e.g., 6500 rph.

Figure 1:
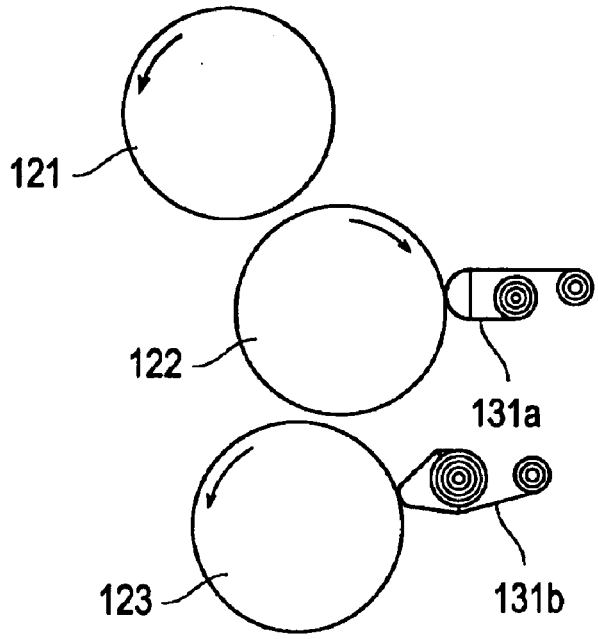
FIG. 1 RELATED ART
FIG. 1 shows the first type of conventional washing device for an impression cylinder jacket.
Figure 2:
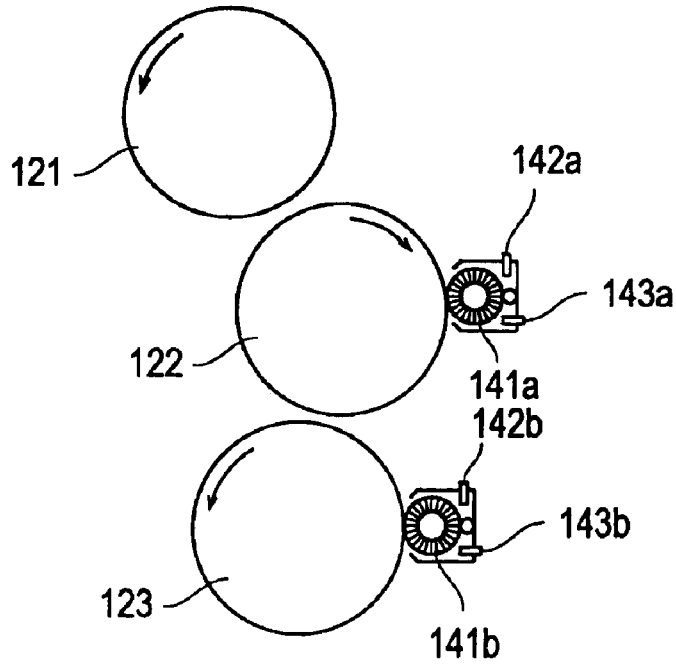
FIG. 2 RELATED ART
FIG. 2 shows the second type of conventional washing device for an impression cylinder jacket.
Figure 3:
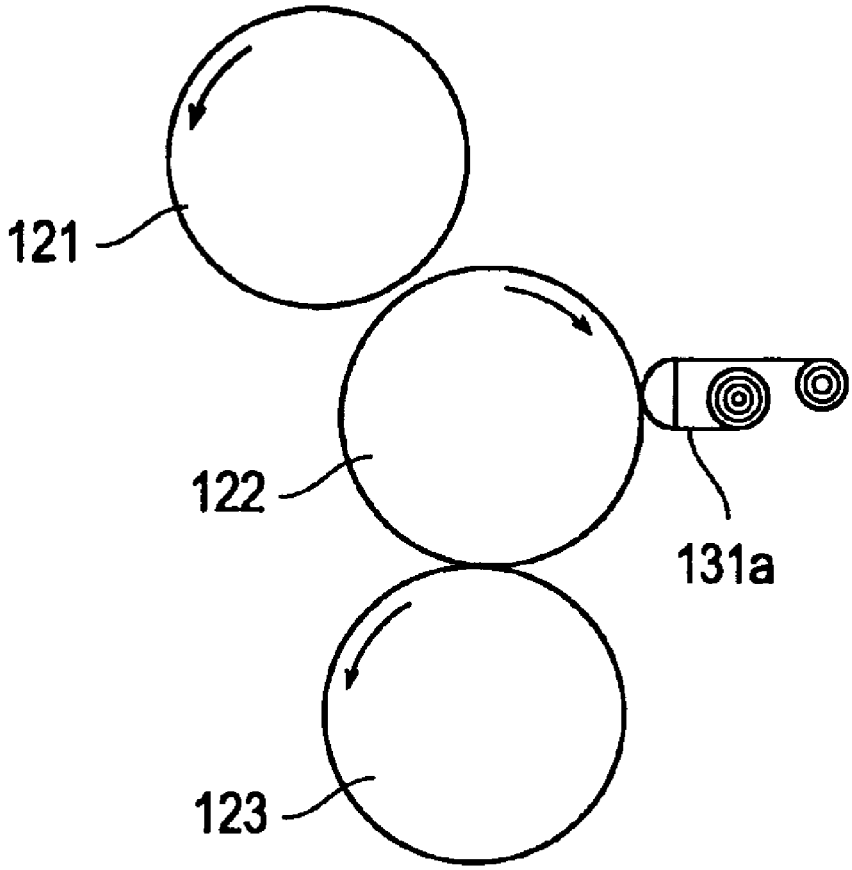
FIG. 3 RELATED ART
FIG. 3 shows the third type of conventional washing device for an impression cylinder jacket.

Next, water form roller 51 is contacted with plate cylinder 21 (S7; ⑥ of FIG. 10). In other words, water form roller 51 in water dampening unit 50 is pressed against the surface of plate cylinder 21 and water is supplied to plate cylinder 21 as shown in FIG. 3. Water form roller 51 of water dampening unit 50 is rotated at a specified speed (water volume).

Figure 13:
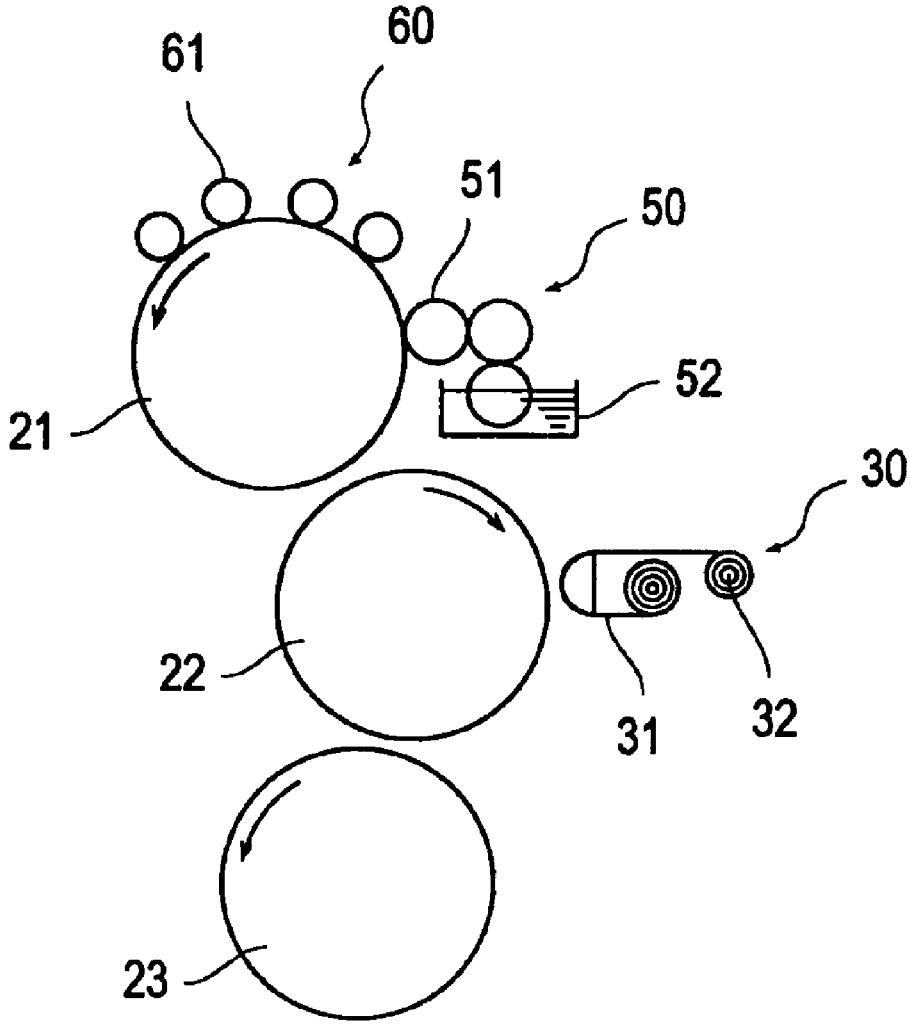
FIG. 13 is a diagram showing the status of each cylinder, a washing mechanism, a water form roller and ink form rollers during a removal cycle of residual washing liquid from a plate.

Ink form rollers 61 are contacted with plate cylinder 21 in several seconds after water form roller 51 is contacted with plate cylinder 21 (S8; ⑦ of FIG. 10). In other words, ink form rollers 61 of inking unit 60 are pressed against the surface of plate cylinder 21 as shown in FIG. 13. As a result, the residual washing solvent put on the surface of the plate mounted on the plate cylinder via the blanket cylinder during the washing of the blanket cylinder and the impression cylinder is absorbed by and transferred to the ink form rollers.

In the present embodiment, even if the cylinder engagement mechanism system is constituted in such a way that blanket cylinder 22 first contacts with plate cylinder 21 and then with impression cylinder 23, the washing liquid which is transferred to the plate via the blanket cylinder causes separation of the residual washing solvent put on the plate comes up on the water as the water is supplied to the plate in step S7 after the simultaneous washing of the blanket cylinder and the impression cylinder, so that the residual washing liquid can be easily absorbed by the ink form rollers by causing the ink form rollers to contact with the plate. Thus, the sensitization of the plate surface can be prevented. Moreover, since this prevents the residual washing liquid from being transferred to water form roller 51 by transferring the residual washing liquid to ink form rollers 61, there will not be caused the bad influence to the downstream printing job.

After achieving the process of removing the washing liquid remaining on the plate by contacting water form roller 51 and ink form rollers 61 with plate cylinder 21 for 30 seconds (arbitrarily adjustable), water form roller 51 and ink form rollers 61 are separated from plate cylinder 21. In other words, water form roller 51 and ink form rollers 61 are separated from the surface of plate cylinder 21 (S9; ⑧ of FIG. 10).

When the removal of the residual washing liquid from the plate surface is finished, the machine (each of cylinders 21 through 23) is run continuously for, e.g., 30 seconds (arbitrarily adjustable), and then will be stopped (S10; ⑨ of FIG. 10). This terminates the washing mode, ending the washing process for the impression cylinder jacket. Rotating each of cylinders 21 through 23 after the cylinder disengagement causes blanket cylinder 22 and impression cylinder 23 to dry up.

Next, an example will be described.

An impression cylinder jacket with a surface roughness of approximately Rmax 35 $\mu$m was prepared by thermally spraying Ni—Cr on a stainless steel (SUS) plate of a thickness of 0.3 mm to a coating thickness of 30 $\mu$m, then thermally spraying ceramics (G-$Al_2O_3$) up to a coating thickness of 40 $\mu$m to make the total plate thickness of 0.37 mm, and then finally coating with a silicone-based separating compounds. This impression cylinder jacket was installed on a sheet-fed offset two-sided printing press (40" format Two-sided 4/4 colors Printing Press Model Lithrone 440SP by Komori Corporation).

Two-sided 4 colors (black, cyan, magenta and yellow) printing was conducted on coated paper using this printing press. Although staining of the impression cylinder jacket was not almost appeared in the early stage of the printing, a certain amount of ink transferred from the paper was appeared on the jacket surface after printing approximately 10000 sheets of paper.

The prior practice has been to wash the blanket after printing approximately 10000 sheets of paper with washing mechanism for a blanket cylinder (a type of pressing nonwoven fabric cloth impregnated with washing liquid against the blanket cylinder jacket) and to wash the impression cylinder jacket with washing mechanism for an impression cylinder (a type of pressing nonwoven fabric cloth impregnated with washing liquid against the impression cylinder). In this case, the fibers left on the jacket were washed out from the jacket by hand as the finishing process.

In an embodiment of the invention, after printing 10000 sheets of paper, the machine (each of cylinders) was rotated at a slow speed (constant 3500 rph) with the washing mechanism turned on to wash only the blanket cylinder to begin with. The nonwoven fabric cloth of the washing mechanism was impregnated with washing solvent and water alternately every two seconds during the washing process. The cylinders were engaged (rotating the blanket cylinder while in contact with the plate cylinder and the impression cylinder) 30 seconds after turning on the washing mechanism. The preset value of the printing pressure between the blanket cylinder and the impression cylinder was 0.05 mm (the condition with both cylinders pushed in 0.1 mm). During the cylinder engagement, the contact between washing mechanism 30 and blanket cylinder 22 was maintained. While the nonwoven fabric cloth is pressed against the blanket cylinder, the plate cylinder, blanket cylinder and the impression cylinder were rotated under contact for 120 seconds to wash the blanket cylinder, the impression cylinder and the plate cylinder together.

After the washing of the blanket cylinder and the impression cylinder, the washing mechanism was turned off, disengaged the cylinders and raised the speed of the machine to a constant speed of 6500 rph.

Next, the water form roller was contacted with the plate cylinder, followed by the contact of the ink form rollers with the plate cylinder three seconds later, to cause the residual washing liquid on the plate surface to transfer to the ink form rollers. The removal of the residual washing liquid on the plate surface was done for 30 seconds after contacting the water form roller with the plate cylinder.

When the water form roller and the ink form rollers were then separated from the plate cylinder, which is followed by an additional 30 seconds of rotating the machine (each of cylinders), and stopping of the machine, an inspection of the plate cylinder, the blanket cylinder and the impression cylinder was conducted, which revealed that the surfaces of not only the blanket cylinder but also the jacket on the impression cylinder were completely removed of the ink. Moreover, no fibers were found on the jacket which are inevitable when it is washed with the nonwoven fabric cloth directly pressed against it, and furthermore paper dust was cleaned as well as a result of water supplied to the jacket because paper dust easily dissolves to water, thus proving that washing device for the impression cylinder jacket of the present invention provides an excellent effect. After washing the blanket cylinder and the impression cylinder and separating the blanket cylinder from the plated cylinder and the impression cylinder, the water form roller and the ink form rollers were rotated while being pressed against the plate cylinder, so that the residual washing liquid on the plate surface as a consequence of washing for the blanket cylinder was absorbed and removed, thus eliminating the possibility of sensitization of the plate surface by the washing liquid from the blanket cylinder and allowing the machine to continue printing jobs without interruption.

The washing device for the impression cylinder jacket based on the contact rotation of the blanket cylinder and the impression cylinder using only washing mechanism for the blanket cylinder is a technology disclosed by said Unexamined Publication No. JP-A-8-12151, also a proven technology by many actual usage examples, and it is know to extend the impression cylinder jackets' life time approximately two fold compared to a case of manual washing. On the other hand, when the washing device for the impression cylinder jacket of a type wherein either nonwoven fabric cloth or a brush roll is pressed directly against the impression cylinder jacket is used, the impression cylinder jacket's life time is reported to be shortened to approximately one half of that of manual washing. As can be seen from the above, the washing device for the impression cylinder jacket disclosed by said publication is an excellent device, it has a limitation that it can be applied only to those sheet-fed offset two-sided printing presses with a cylinder engagement mechanism system wherein the blanket cylinder makes a contact with the impression cylinder first, and then with a plate cylinder.

In other words, as already described, the washing device for the impression cylinder jacket disclosed by said publication cannot be used on a printing press with a cylinder engagement mechanism system in which the blanket cylinder inevitably comes to contact with both the plate cylinder and the impression cylinder simultaneously when the blanket cylinder is brought to contact with the impression cylinder for the purpose of washing, because trying to wash using only the washing mechanism that has the cleaning unit for the blanket cylinder while the blanket cylinder is in contact with the impression cylinder, the washing liquid moves from the blanket cylinder to the plate cylinder and causes sensitization of the plate surface. The invention solved said problem that the plate cylinder essentially needs to be separated from the blanker cylinder after the washing in order to avoid its contact with the washing liquid, by first washing the blanket cylinder and the impression cylinder together with the blanket cylinder contacting the plate cylinder and then adding a new process of separating the blanket cylinder from the plate cylinder after the simultaneous washing of the blanket cylinder and the impression cylinder and pressing the water form roller against the plate cylinder to supply water to the plate cylinder while also pressing the ink form rollers against the plate cylinder. This made it possible to prevent the sensitization of the plate surface by allowing the ink form rollers to adsorb the washing liquid put on the plate surface via the blanket cylinder during the washing of the blanket cylinder and the impression cylinder. Consequently, an effect identical to the effect of the abovementioned washing device for the impression cylinder jacket disclosed by said publication can be extended to almost all sheet-fed offset two-sided printing presses and the effect of the invention is quite substantial.

It is obvious that this invention is not limited to the particular embodiments shown and described above but may be variously changed and modified without departing from the technical concept of this invention.

For example, although the abovementioned embodiment is described assuming a case where the washing device for the impression cylinder jacket of the invention is applied to a sheet-fed offset two-sided printing press designed for printing both sides of paper without reversing paper, it goes without saying that the invention can be applied to a press where the paper is reversed in the middle of the process.

Also, it is possible to use nonwoven fabric cloth impregnated with the washing liquid (washing solvent) prior to the washing process in the washing mechanism. In such a case, it is preferable to exchange the order of the executions of step S7 and step S8 in the flowchart of FIG. 9. In other words, since a relatively large amount of washing solvent is remaining on the plate surface at the time when the cylinder disengagement process of step S6 is done, the ink form rollers is contacted with the plate cylinder first to cause the ink form rollers to adsorb some of the washing solvent and then, after a specified period of time (e.g., 5 seconds), the water form roller is connected with the plate cylinder. By taking such a procedure, it is possible to prevent the washing solvent supplied during the washing for the blanket cylinder from reaching the water form roller.

This application is based on Japanese Patent Application No. 2003-46177 filed on Feb. 24, 2003, the contents of which are hereby incorporated by reference.

What is claimed is:

1. A method of washing an impression cylinder in a sheet-fed offset two-sided printing press, comprising the steps of:

providing an impression cylinder having a low surface-energy coating, such that said impression cylinder is resistant to the transfer of ink;

providing a blanket cylinder, capable of engaging said impression cylinder;

providing a washing unit capable of providing washing fluid, and capable of engaging said blanket cylinder;

providing a plate cylinder, capable of engaging said blanket cylinder;

transferring washing fluid from said washing unit to said impression cylinder via said blanket cylinder, said step of transferring comprising engaging, while rotating, said blanket cylinder with said impression cylinder, with said plate cylinder and with said washing unit, thereby washing said impression cylinder;

removing washing fluid from said plate cylinder, said step of removing comprising:

disengaging said blanket cylinder from said impression cylinder, said plate cylinder and said washing unit;

providing a water roller capable of contacting said plate cylinder;

providing an ink roller capable of contacting said plate cylinder; and contacting, while rotating, said plate cylinder with said water roller and with said ink roller, such that said washing fluid is removed from said plate cylinder.

2. The method recited in claim 1 wherein said step of providing an impression cylinder having a low surface-energy coating further comprises attaching an impression cylinder jacket to said impression cylinder, said impression cylinder jacket comprising a flexible metal plate, a convex-concave profiled base layer formed on said flexible metal plate and low surface energy coating on said base layer.

3. The method recited in claim 1 further comprising the step of engaging said blanket cylinder with said washing unit prior to said step of transferring said washing fluid.

4. The method recited in claim 1 further comprising the step of engaging said ink roller with said plate roller prior to said contacting said plate cylinder with said water roller.

5. An apparatus for washing an impression cylinder in a sheet-fed offset two-sided printing press, comprising:

an impression cylinder having a low surface-energy coating, such that said impression cylinder is resistant to the transfer of ink;

a blanket cylinder, capable of engaging said impression cylinder;

a plate cylinder, capable of engaging said blanket cylinder;

a cylinder engagement mechanism capable of engaging, while rotating, said blanket cylinder with said impression cylinder jacket, with said plate cylinder;

a washing unit capable of providing washing fluid, and capable of engaging said blanket cylinder, such that washing fluid is transferred from said washing unit to said impression cylinder via said blanket cylinder when said cylinders are engaged and rotated, thereby indirectly washing said impression cylinder; and a water roller capable of contacting said plate cylinder and an ink roller capable of contacting said plate cylinder, such that when said water roller and said ink roller are contacted with said plate cylinder, and said plate cylinder is disengaged from said blanket cylinder, and rotated, said washing fluid is removed from said plate cylinder.

6. The apparatus recited in claim 5 further comprising an impression cylinder jacket attachably connected to said impression cylinder, said impression cylinder jacket comprising a flexible metal plate, a convex-concave profiled base layer formed on said flexible metal plate and low surface energy coating on said base layer.

* * * * *